US008213835B2

(12) United States Patent
Okamoto

(10) Patent No.: US 8,213,835 B2
(45) Date of Patent: Jul. 3, 2012

(54) IMAGE FORMING APPARATUS PROVIDED WITH TRANSFER ROLLER

(75) Inventor: Sueaki Okamoto, Osaka (JP)

(73) Assignee: Kyocera Mita Corporation (JP)

( * ) Notice: Subject to any disclaimer, the term of this patent is extended or adjusted under 35 U.S.C. 154(b) by 52 days.

(21) Appl. No.: 12/787,502

(22) Filed: May 26, 2010

(65) Prior Publication Data

US 2010/0303517 A1 Dec. 2, 2010

(30) Foreign Application Priority Data

May 27, 2009 (JP) ..... 2009-127881

(51) Int. Cl.
*G03G 15/00* (2006.01)

(52) U.S. Cl. ..... 399/167; 399/121; 399/313

(58) Field of Classification Search ..... 399/66, 399/121, 159, 167, 297, 310, 313, 314, 318
See application file for complete search history.

(56) References Cited

U.S. PATENT DOCUMENTS 3,942,888 A * 3/1976 Maksymiak et al. ..... 399/313
5,432,590 A * 7/1995 Nomura et al. ..... 399/167
6,016,416 A * 1/2000 Kitamura ..... 399/167
6,072,977 A * 6/2000 Murakami ..... 399/313
2006/0045580 A1* 3/2006 Matsuura ..... 399/316

FOREIGN PATENT DOCUMENTS

JP 6-130846 5/1994
JP 2006-113283 4/2006

* cited by examiner

*Primary Examiner* — Walter L Lindsay, Jr.
*Assistant Examiner* — Benjamin Schmitt
(74) *Attorney, Agent, or Firm* — Gerald E. Hespos; Michael J. Porco

(57) ABSTRACT

An image forming apparatus has an image bearing member on which a toner image is to be formed. A transfer roller contacts a surface of the image bearing member for transferring a toner image on the image bearing member to one side of a transfer medium by applying a voltage having a polarity opposite to that of the toner image on the image bearing member from the other side of the transfer medium. A biasing member biases the transfer roller toward the image bearing member. The transfer roller is shaped such that the outer diameter of a first part corresponding to the width of a specified sheet size is constant and the outer diameters of second parts located closer to opposite ends of the transfer roller than the first part are gradually increased toward the outer sides in an axial direction.

11 Claims, 8 Drawing Sheets

IMAGE FORMING APPARATUS PROVIDED WITH TRANSFER ROLLER

BACKGROUND OF THE INVENTION

1. Field of the Invention

The present invention relates to an image forming apparatus with an improved print quality such as a copier, a printer, a facsimile machine or a complex machine of these.

2. Description of the Related Art

Conventionally, there has been known the following electrophotographic image forming apparatus. An electrostatic latent image is formed by exposing a surface of a photoconductive drum including a photoconductive layer made of OPC, amorphous silicon or the like and uniformly charged by a charger with light from a laser, an LED or the like in accordance with image information. This electrostatic latent image is developed into a toner image by a developing unit and this toner image is transferred to a transfer medium (sheet) by a transfer unit. The transfer medium is separated from the photoconductive drum by a separator and the toner image on the transfer medium is fixed to the transfer medium by a fixing device to output an image.

In such an image forming apparatus, a bias power supply is disposed to apply a bias voltage to a transfer roller when the transfer medium passes a transfer nip between the photoconductive drum (image bearing member) and the transfer roller. When a transfer bias having a polarity opposite to that of toner is applied by the bias power supply, the toner image on the photoconductive drum is transferred to the transfer medium by a transfer electric field. Further, a cleaning member for removing the toner residual on the surface of the photoconductive drum after the image transfer is disposed downstream of the transfer nip in a rotating direction of the photoconductive drum.

In the case of using an amorphous silicon (a-Si) photoconductor as an image bearing member, a surface of the photoconductor is positively charged by a charging roller and an electrostatic latent image after exposure undergoes reversal development with positively charged toner. In a subsequent transfer process, the toner image is transferred to a transfer medium by applying a negative bias having a polarity opposite to that of the toner to a transfer roller.

In the case of using an amorphous silicon photoconductive drum, an output current of a transfer bias needs to be increased to obtain a necessary transfer electric field since a resistance value or a capacitive component of a photoconductive layer is small in relation to the negative transfer bias. Particularly, an output current is set to be relatively high for a transfer medium of a size with a short width since a ratio of a part of the transfer roller directly in contact with the photoconductor is large as compared with the case where a transfer medium has a large width.

Amorphous silicon drums are suitable for a long life and incorporated in high-speed and high-durability machines since it has a high surface hardness and is difficult to abrade. Thus, the transfer roller is required to have a small resistance variation and a good durability even in such a use environment where a large current flows. For example, a foam sponge roller of the electron conductive type obtained by dispersing carbon in an EPDM as a base polymer to provide conductivity is used as a transfer roller having a high durability and a small resistance variation even if a large current bias is applied. In this transfer roller, a volume resistance value is preferably about 7 to 7.5 log Ω. In view of resistance stability, the dispersion amount of the carbon needs to be increased, wherefore the rubber hardness of the transfer roller is consequently about 35 degrees or higher.

On the other hand, in a transfer roller of the ion conductive type, there are problems that a resistance variation in a use environment (temperature and humidity) is large and resistance increases due to the application of a large current of a transfer bias. If the rubber of the transfer roller has a low hardness, the transfer roller may be abraded after a long-term use and, in such a case, problems such as a skew, a magnification defect and a transfer deviation may possibly occur.

Thus, if a transfer roller has a high durability in an image forming apparatus including an amorphous silicon drum, the rubber hardness thereof exceeds 35 degrees in many cases.

Generally, there is often a speed difference (4% to 6%) between a photoconductor and a transfer roller in an image forming apparatus for directly transferring a toner image to a transfer medium using a photoconductive drum. This is to maintain a transfer medium conveying speed in a nip between the photoconductive drum and the transfer roller against a conveyance load of a pre-transfer guide. Thus, the transfer roller is likely to vibrate and to be separated from the photoconductive drum due to this vibration, for example, if transfer press is set to be low or frictional forces between the transfer roller and the photoconductor or the transfer medium are large.

As shown in FIGS. 8A and 8B (same reference numerals as in embodiments are given), a driving force of a transfer roller 10 is input from a transfer gear 55 mounted on one end of a rotary shaft of the transfer roller 10. Depending on a speed difference and a frictional force between a photoconductive drum 7 or a transfer medium S and the transfer roller 10, a driving force from a drive gear 57, transfer load setting or the like, a vibrating state (escaping motion from the drum) of the transfer roller 10 differs. For example, if a frictional force between the photoconductive drum 7 (or transfer medium S) and the transfer roller 10 becomes larger, a torque of the drive gear 57 for driving the transfer roller 10 increases and a driven side at one side of the roller shaft, to which the torque is input, comes to more easily escape (see FIG. 8B). Accordingly, in load setting of the transfer roller 10, a load is generally larger at the side of the drive gear 57.

A first problem of the above construction is as follows. In the case of using the transfer roller 10 having a relatively high rubber hardness, it is assumed that a transfer medium S having a width shorter than a longitudinal dimension of a rubber part of the transfer roller (i.e. narrow sheet) is passed through. In this case, as shown in FIG. 8A, air gaps "a" are formed between the transfer roller 10 and the photoconductive drum 7 due to the thickness of the transfer medium S and the vibration (escaping motion) of the transfer roller near (1 to 2 mm) the opposite end edges of the transfer medium S in a part where the transfer roller 10 and the transfer medium S are in contact. This results from the inability of rubber elasticity to follow the air gaps due to the high rubber hardness of the transfer roller. Thus, there are cases where the surface of the photoconductor is destroyed and black dots appear in a transferred image in long-term use.

A second problem is as follows. As described above, the driving force of the transfer roller 10 is input to the one end of the rotary shaft of the transfer roller and a biasing force of the transfer roller 10 is larger at the drive gear side and smaller at a non-driven side. In this way, it has been tried to make a contact pressure between the transfer roller and the photoconductive drum uniform. However, since the frictional force between the photoconductor or the transfer medium and the transfer roller changes due to various conditions, either one of the opposite ends in a longitudinal direction more easily escapes in many cases. Thus, a large air gap "b" may be formed at one end side and a small air gap "c" may be formed at the other end side as shown in FIG. 8B.

When a transfer medium of a small size is passed through, a surface friction coefficient in sheet non-passage areas of the photoconductive drum 7 is likely to be higher due to the influence of the adhesion of ozone products caused by the discharge of the transfer roller and the absence of surface polishing by the transfer medium. Thus, the frictional force in a contact part with the transfer roller 10 becomes larger and the driven side more easily escapes (air gaps c>b). Conversely, when a transfer medium of a large size is passed through, the transfer roller and the photoconductive drum are not in contact, wherefore the non-driven side more easily escapes (air gaps b>c) if the frictional force is smaller as compared with the case where the transfer medium has a small size. However, this condition changes depending on the surface μ of the transfer medium.

If the transfer press is excessively increased, problems such as polishing nonuniformity of the surface of the photoconductive drum 7 and a hollow phenomenon at the time of passing a thick sheet occur. Accordingly, it is difficult to prevent the vibration of the transfer roller only by the transfer load setting. In this case, a voltage to be discharged in a clearance increases in a state of a large transfer bias output and if this voltage exceeds a withstanding voltage of the drum, a photoconductive layer is destroyed. As a result, electric charges can be no longer retained on the surface of the photoconductor, whereby black dots appear in an image.

SUMMARY OF THE INVENTION

An object of the present invention is to provide an image forming apparatus capable of preventing the formation of black dots caused by the destruction of a photoconductive layer outside the widthwise edge portions of a sheet and suppressing jitter and density unevenness caused by the vibration of a transfer roller.

In order to accomplish this object, one aspect of the present invention is directed to an image forming apparatus, including an image bearing member on which a toner image is to be formed; a transfer roller held in direct contact with a surface of the image bearing member for transferring a toner image on the image bearing member to one side of a transfer medium by applying a voltage having a polarity opposite to that of the toner image formed on the image bearing member from the other side of the transfer medium; a driving mechanism for respectively rotating the transfer roller and the image bearing member with a specified speed difference; and a biasing member for biasing the transfer roller toward the surface of the image bearing member, wherein the transfer roller is shaped such that the outer diameter of a first part corresponding to the width of a specified sheet size is constant and the outer diameters of second parts located closer to the opposite ends of the transfer roller than the first part are gradually increased toward the outer sides in an axial direction of the transfer roller.

Another aspect of the present invention is directed to an image forming apparatus, including a cylindrical image bearing member on which a toner image is to be formed; a transfer roller held in direct contact with a surface of the image bearing member for transferring a toner image on the image bearing member to one side of a transfer medium by applying a voltage having a polarity opposite to that of the toner image formed on the image bearing member from the other side of the transfer medium; a drive gear mounted coaxially with the image bearing member for rotating the image bearing member about an axis; a transfer gear mounted coaxially with the transfer roller and meshed with the drive gear to rotate the transfer roller about an axis; a driving mechanism for respectively rotating the transfer roller and the image bearing member with a specified speed difference; and a biasing member for biasing the transfer roller toward the surface of the image bearing member, wherein the drive gear includes a first drive gear mounted on a third end portion of the image bearing member and a second drive gear mounted on a fourth end portion opposite to the third end portion, and the transfer gear includes a first transfer gear mounted on a fifth end portion of the transfer roller and meshed with the first drive gear and a second transfer gear mounted on a sixth end portion opposite to the fifth end portion and meshed with the second drive gear.

BRIEF DESCRIPTION OF THE DRAWINGS

FIGS. 8A and 8B are front views showing a relationship of gaps between a transfer roller and a photoconductive drum of a conventional image forming apparatus, wherein FIG. 8A shows air gaps formed at the opposite ends of a sheet when the width of the sheet is narrow in relation to that of the transfer roller and FIG. 8B shows air gaps formed due to a difference in a frictional force between the transfer roller and the photoconductive drum.

DETAILED DESCRIPTION OF THE PREFERRED EMBODIMENTS

Figure 1:
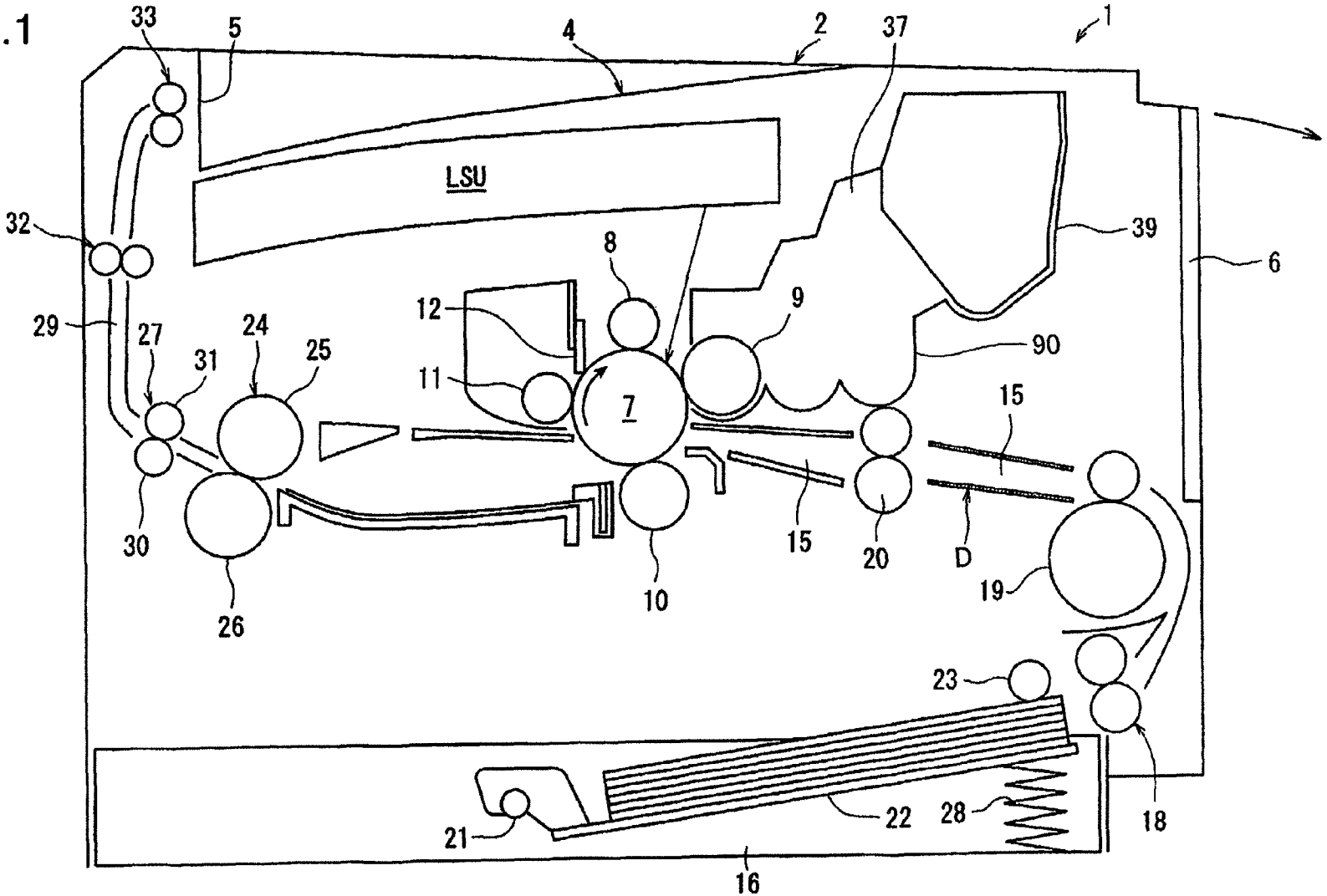
FIG. 1 is a schematic section of an image forming apparatus according to a first embodiment of the invention.

An image forming apparatus according to a first embodiment of the present invention is described with reference to the accompanying drawings. With reference to FIG. 1, a laser printer 1 (hereinafter, referred to merely as the "printer 1") as an example of the image forming apparatus includes a printer main body 2 having a substantially rectangular parallelepipedic housing structure. Right side of the printer main body 2 in FIG. 1 is referred to as front side of the apparatus.

A sheet cassette 16 is arranged at the bottom of the printer main body 2. A bottom plate 22 as a sheet placing plate having one end thereof supported rotatably about a shaft 21, a compression coil spring 28 for pushing up the other end of the bottom plate 22, etc. are arranged in the sheet cassette 16. The upper surface of the leading end of the uppermost one of sheets stacked and accommodated on the bottom plate 22 is pressed in contact with a pickup roller 23 arranged in the printer main body 2. The pickup roller 23 functions to pull the sheet (transfer medium) out from the sheet cassette 16 toward a conveyance path 15.

A separation roller pair 18 is disposed at the entrance of the conveyance path 15, and a conveyor roller pair 19 and a registration roller pair 20 are arranged downstream of this separation roller pair 18. A sheet detection sensor D capable of detecting a sheet being conveyed is arranged upstream of the registration roller pair 20.

A photoconductive drum 7 as an image bearing member is arranged downstream of the registration roller pair 20 in a substantially central area of the interior of the printer main body 2 and driven and rotated in a clockwise direction in FIG. 1. A photoconductor of the photoconductive drum 7 used is made of amorphous silicon (or material containing amorphous silicon).

A main charging roller 8, a developing sleep 9 of a developing device 90, a transfer roller 10, a cleaning roller 11, a cleaning blade 12, an unillustrated charge neutralizer and the like are arranged around the photoconductive drum 7. The developing device 90 includes the developing sleeve 9 arranged in a development housing 37 and a toner cartridge 30 for supplying toner into the development housing 37. A laser scanning unit LSU for converting input image information into a laser beam and irradiating a surface of the photoconductive drum 7 is arranged at an upper position in the interior of the printer main body 2.

When a charging bias is applied to the main charging roller 8 by an unillustrated charging bias power supply, the surface of the photoconductive drum 7 is uniformly charged. In this embodiment, a positive charging bias is applied and the surface of the photoconductive drum 7 is uniformly positively charged.

By being exposed by the laser scanning unit LSU, an electrostatic latent image is formed on the surface of the photoconductive drum 7. When a developing bias is applied to the developing sleeve 9 by an unillustrated charging bias power supply, the electrostatic latent image is developed. In this embodiment, an AC bias superimposed with a DC component having the same positive polarity as the polarity of the charging bias is applied as the developing bias. By the application of this developing bias, toner as a magnetic one-component developer is attached to the electrostatic latent image formed on the surface of the photoconductive drum 7. In this way, the electrostatic latent image is developed into a toner image.

Figure 2:
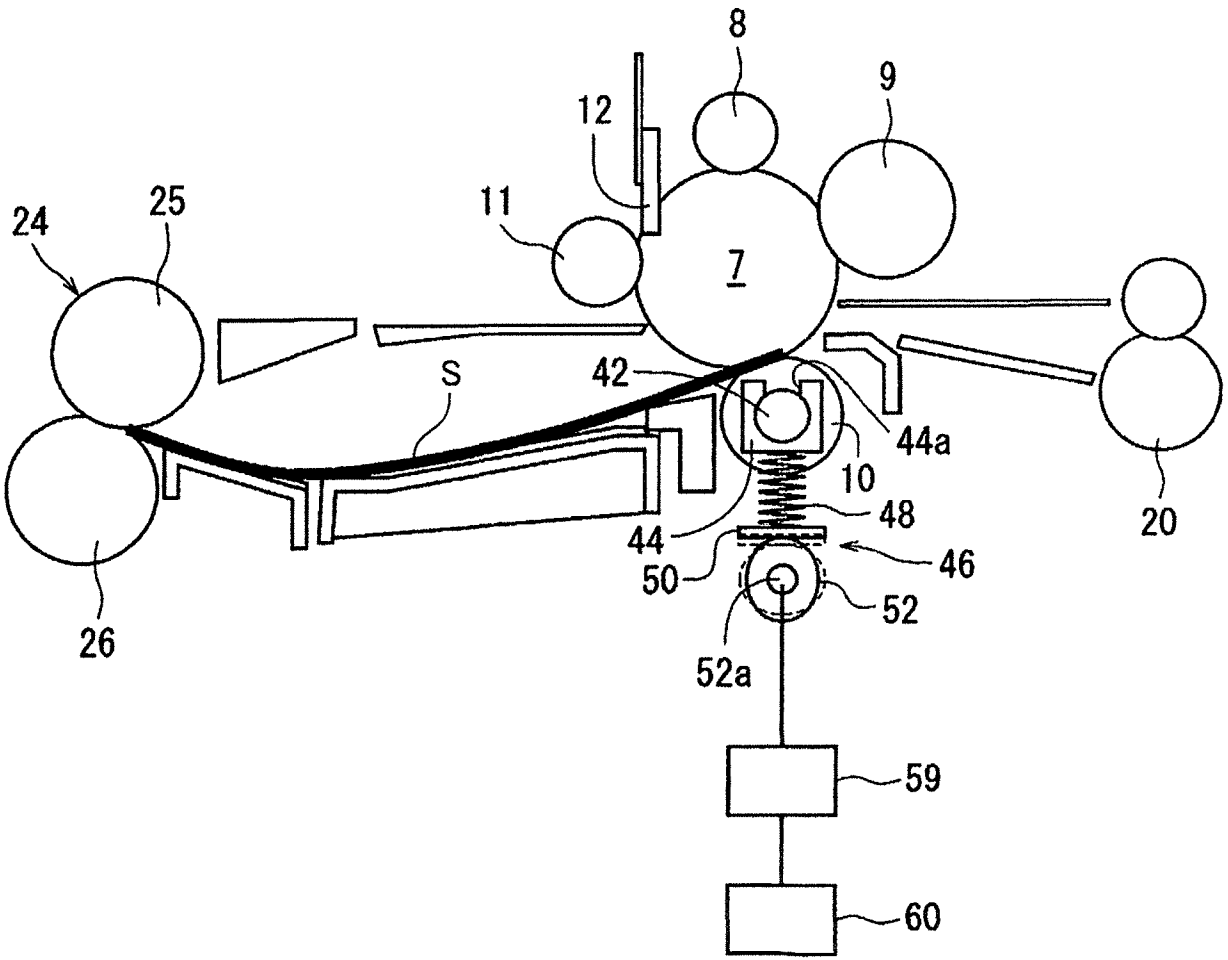
FIG. 2 is a schematic section of a part near a photoconductive drum and a transfer roller of FIG. 1.

Next, the transfer roller 10 according to the first embodiment and its surrounding structures are described in detail with reference to FIGS. 2 to 4. FIG. 2 is a schematic side view showing an image forming unit and its periphery, FIG. 3 is a front view of the transfer roller 10 and FIG. 4 is a front view showing a state where the photoconductive drum and the transfer roller are arranged side by side.

The transfer roller 10 forms a transfer nip by being held in direct contact with the surface of the photoconductive drum 7. The transfer roller 10 applies a voltage having a polarity opposite to that of a toner image formed on the photoconductive drum 7 to a sheet passing the transfer nip from the other side of the sheet. In this way, the toner image on the photoconductive drum 7 is transferred to one side of the sheet.

In this embodiment, the transfer roller 10 is arranged below the photoconductive drum 7 and includes a roller main body 41 and a roller shaft 42 for rotating the roller main body 41 about an axis. A foam sponge roller of the electron conductive type provided with a conductive property by dispersing and mixing carbon in an EPDM base polymer can be used as the roller main body 41. The roller main body having a volume resistance value of about 7 to 7.5 log Ω and a rubber hardness of about 35 degrees or higher is preferably used.

Figure 3:
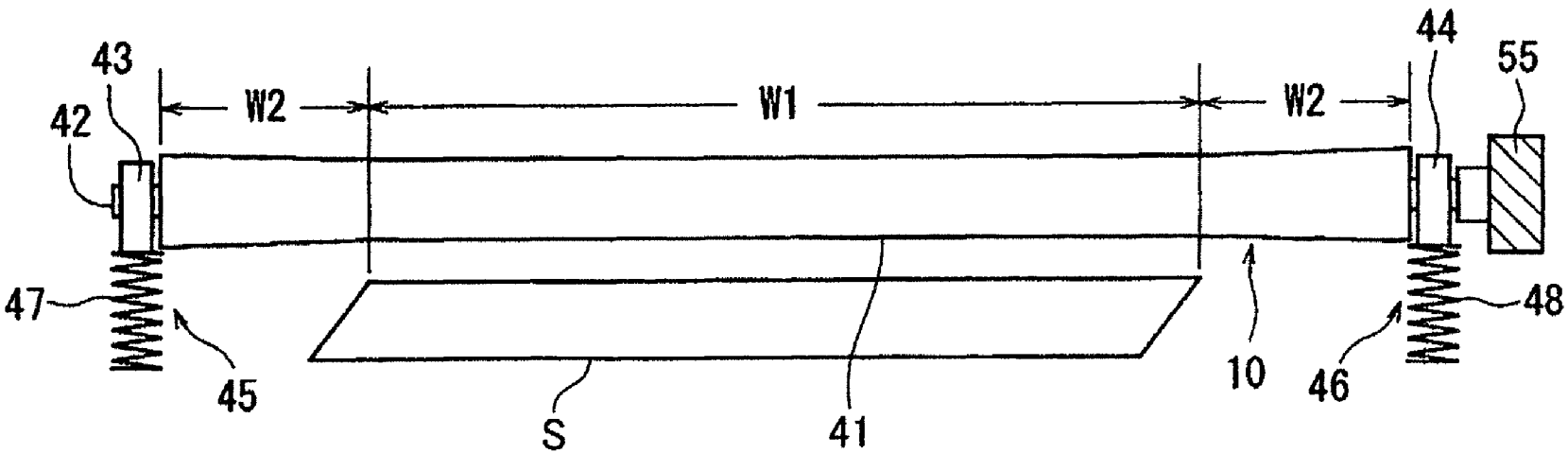
FIG. 3 is a front view showing the transfer roller used in the first embodiment of the invention and a part of its periphery.
Figure 4:
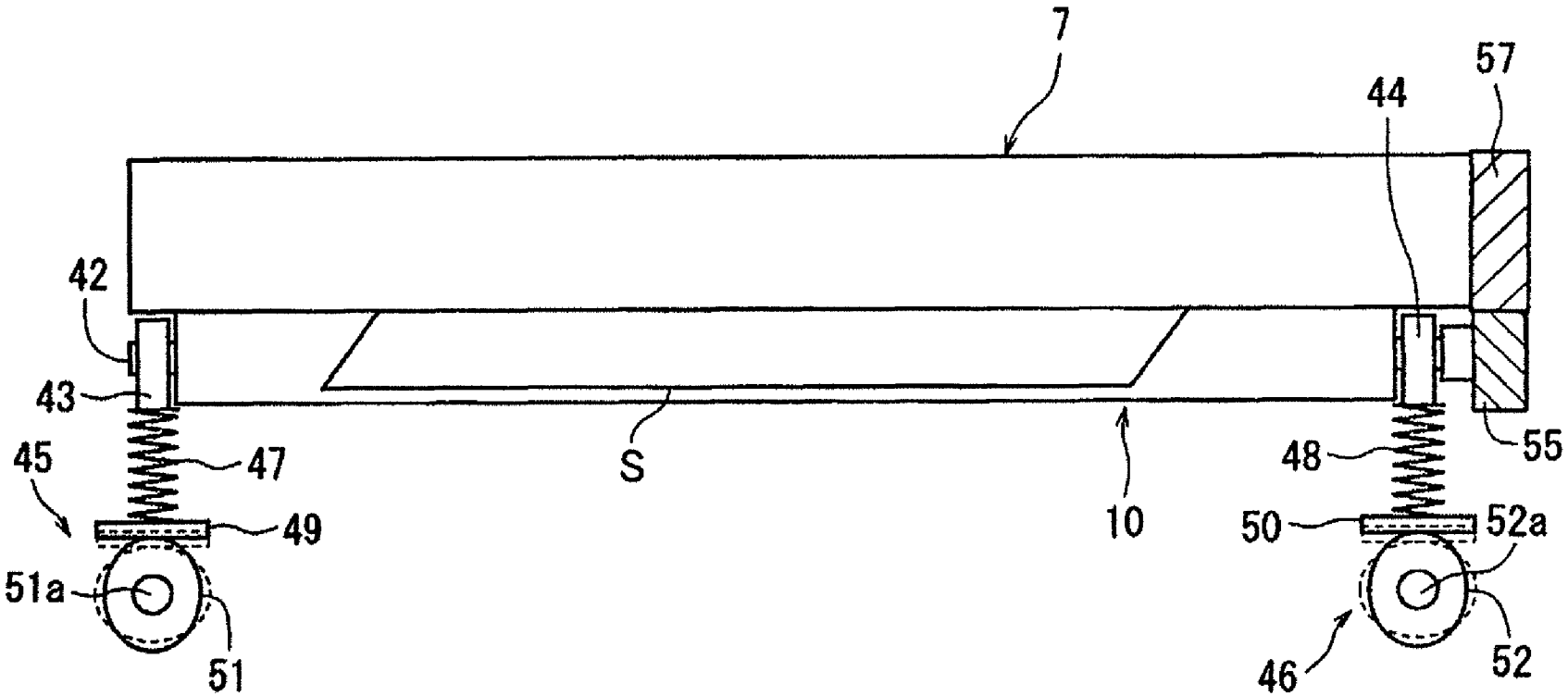
FIG. 4 is a front view showing the photoconductive drum and the transfer roller used in the first embodiment and a part of their periphery.

As shown in FIG. 3, the roller main body 41 have a constant outer diameter in an intermediate area W1 (first part) in a longitudinal direction (the axial direction of the transfer roller 10) of the roller shaft 42, and the outer diameters of outer areas W2 (second parts) at the opposite sides of the intermediate area are gradually and moderately increased toward the outer sides in the longitudinal direction of the roller shaft 42, i.e. have a reverse crown shape. There are two ways of determining the width of the intermediate area W1 (width of a specified sheet size). One is to set the minimum width of sheets S, which can pass the transfer roller 10, as the intermediate area W1, and the other is to set the width of most frequently used sheets S excluding large size sheet widths out of sheets used in the printer main body 2 as the intermediate area W1. Of course, the formed position of the intermediate area W1 is so set as to coincide with a position to be touched by these sheets when they pass the transfer nip.

Similar to a roller shaft (not shown) of the photoconductive drum 7, the roller shaft 42 of the transfer roller 10 is so arranged that the center thereof extends in a width direction of the printer main body 2. A left end portion (first end portion) and a right end portion (second end portion) of the roller shaft 42 are respectively rotatably supported by roller bearings 43, 44. Each of the roller bearings 43, 44 has a rectangular cross section and includes a U-shaped supporting groove 44*a* having an open upper side and extending upward from a central part. Although only one roller bearing 44 is shown in FIG. 2, the other roller shaft 43 is identically shaped. The end portions of the roller shaft 42 are fitted into these supporting grooves 44*a* to be supported therein.

The respective bearings 43, 44 are supported by biasing force changing mechanisms 45, 46 for switching biasing forces of the transfer roller 10 to the photoconductive drum 7. The left biasing force changing mechanism 45 in FIG. 4 applies a biasing force to the left bearing 43 and the right biasing force changing mechanism 46 applies a biasing force to the right bearing 44.

As shown in FIG. 4, the respective biasing force changing mechanisms 45, 46 include coil springs 47, 48, operation plates 49, 50 and eccentric cams 51, 52. The upper ends of the coil springs 47, 48 are attached to the bottoms of the roller bearings 43, 44 arranged in correspondence, and the bottom ends thereof are attached to the operation plates 49, 50 in the form of flat plates. The coil springs 47, 48 are mounted in a compressed state between the lower surfaces of the roller bearings 43, 44 and the upper surface of the operation plates 49, 50. The eccentric cams 51, 52 are arranged in contact with the lower surfaces of the operation plates 49, 50. The eccentric cams 51, 52 are integrally supported on eccentric shafts 51*a*, 52*a* (only one is shown in FIG. 2) mounted on unillustrated fixing portions of the printer main body 2. The eccentric cams 51, 52 are in contact with the lower surfaces of the operation plates 49, 50 and the operation plates 49, 50 can vertically move since radial-direction dimensions of the eccentric cams 51, 52 vary as the eccentric cams 51, 52 are rotated.

When the operation plates 49, 50 vertically move, distances between the roller bearings 43, 44 and the operation plates 49, 50 change to extend or contract the coil springs 47, 48. As a result, biasing forces of the coil springs 47, 48 are transmitted to the transfer roller 10 via the roller shaft 42, whereby the transfer roller 10 gives a transfer pressing force to the photoconductive drum 7.

As shown in FIG. 2, the eccentric shafts 51*a*, 52*a* of the eccentric cams 51, 52 are coupled to a mechanism unit 59 including a control motor coupled to the eccentric shafts 51*a*, 52*a*. The mechanism unit 59 is electrically connected to a controller 60 for controlling the mechanism unit 59. The controller 60 controls angles of rotation of the eccentric cams 51, 52 according to the sheet size, a coefficient of friction of the photoconductive drum 7 and the like using unillustrated sheet selection buttons and sheet width detection sensor provided in the printer main body 2. The controller 60 can independently control the respective biasing force changing mechanisms 45, 46 so that the transfer pressing forces of the transfer roller 10 to the photoconductive drum 7 can be made equal or different at the left and right end portions of the roller shaft 42.

In this embodiment, a driving mechanism is provided to rotate the photoconductive drum 7 and the transfer roller 10 with a specified speed difference. The driving mechanism of this embodiment includes a transfer gear 55 and a drive gear 57. With reference to FIG. 4, the end portion of the roller shaft 42 at one (right) side of the transfer roller 10 penetrates through the roller bearing 44 and the transfer gear 55 in the form of a helical gear is mounted on the leading end thereof. The transfer gear 55 is meshed with the drive gear 57 in the form of a helical gear mounted on an end of the photoconductive drum 7. A speed ratio of the transfer gear 55 and the drive gear 57 is so set that the rotational speed of the outer circumferential surface of the transfer roller 10 is 4% to 6% faster than that of the outer circumferential surface of the photoconductive drum 7.

Since the transfer roller 10 applies the transfer pressing forces to the photoconductive drum 7 by spring loads of the coil springs 47, 48, the roller shaft 42 is not fixed.

Referring back to FIG. 1, a fixing device 24 is arranged downstream of the photoconductive drum 7 in the conveyance path 15. The fixing device 24 includes a heat roller 25 and a pressure roller 26 pressed in contact with the heat roller 25 from below. A conveyor roller pair 27 is arranged downstream of the fixing device 24 in the conveyance path 15. The conveyor roller pair 27 includes a drive roller 30 and a driven roller 31 pressed in contact with the drive roller 30. A discharge path 29 is arranged downstream of the conveyor roller pair 27.

The discharge path 29 extends upward along the inner surface of the rear wall of the printer main body 2, and an upper end portion thereof is curved toward the front side of the printer main body 2 to be connected with a discharge port 5. A conveyor roller pair 32 is arranged at a substantially vertical center position of the discharge path 29, and a discharge roller pair 33 is arranged at the upper end (downstream end). Each of the conveyor roller pair 32 and the discharge roller pair 33 is composed of a drive roller and a driven roller pressed in contact with the drive roller.

A discharge tray 4 is formed in the upper surface of the printer main body 2. The discharge tray 4 is formed by an inclined surface moderately inclined to locate its rear side at a lower position and a flat surface continuously extending forward from the front end of this inclined surface. Sheets discharged forward from the sheet discharge port 5 after image formation to be described later are placed on the discharge tray 4. A sheet tray lid 6 for manual feed is arranged on the front surface of the printer main body 2 and constructed such that its upper side is openable forward.

Although not shown, the printer main body 2 is provided with a known function for detecting the sheet size using sheet selection buttons of a personal computer or a printer or a sheet size detection sensor arranged in the printer main body 2.

Next, functions of the image forming apparatus 1 according to the first embodiment are described. In the first embodiment (same as in second and third embodiments below), it is assumed that large-size sheets are A4-size sheets (second-size transfer media) and small-size sheets frequently used are B5-size sheets (first-size transfer media).

For example, a case is assumed where printing is performed using an A4-size sheet accommodated in the sheet cassette 16 in the printer 1 shown in FIG. 1. A print signal for A4 size is transmitted from a personal computer to the controller 60 of the printer 1 by a user to input sheet information in the controller 60 of the printer main body 2. Here, if the biasing force changing mechanisms 45, 46 are not so set as to give biasing forces suitable for the A4 size as the large size to the transfer roller 10, the controller 60 controls the mechanism unit 59 to set the eccentric cams 51, 52 at positions suitable for the A4 size.

For example, if the biasing force changing mechanisms 45, 46 are set for the B5 size, the controller 60 rotates the eccentric cams 51, 52 to narrow the distances between the roller bearings 43, 44 and the operation plates 49, 50 to set the eccentric cams 51, 52 at the positions suitable for the A4 size. At this time, the controller 60 switches the transfer pressing forces of the transfer roller 10 to the photoconductive drum 7 separately for a driven side (side where the transfer gear 55 is located) at the right end of the roller shaft 42 and a non-driven side at the left end in consideration of the sheet size, the sheet thickness, the temperature/humidity environment, the image density, the surface state of the photoconductive drum, the processing speed and the like.

Normally, the controller 60 sets the biasing force changing mechanisms 45, 46 in such a direction as to compress the coil springs 47, 48, thereby increasing the transfer pressing forces of the transfer roller 10 to the photoconductive drum 7 since a large-size sheet is to be passed. As described in the description of the prior art, a frictional force of the transfer roller is small when a large-size sheet is passed and the non-driven side more easily escapes. Thus, if necessary, the transfer pressing force at the roller bearing 43 at the non-driven side is set stronger than normally during the transfer to eliminate an air gap, thereby preventing the destruction of a photoconductive layer of the photoconductive drum 7 by a discharge.

Subsequently, the surface of the photoconductive drum 7 uniformly charged by the main charging roller 8 is exposed to light by the laser scanning unit LSU, whereby an electrostatic latent image is formed on the surface of the photoconductive drum 7. This electrostatic latent image is developed into a toner image by the developing device 90. This toner image is transferred to one side of a sheet S conveyed at a specified timing from the sheet cassette 21 by the transfer roller 10 of the transfer device.

When the A4-size sheet S passes through the transfer nip between the photoconductive drum 7 and the transfer roller 10, it is conveyed while extending to the outer areas W2 beyond the intermediate area W1 of the transfer roller 10. Accordingly, only small parts of the transfer roller 10 and the photoconductive drum 7 are in direct contact and the image is transferred to the sheet in a relatively stable state.

If necessary, the controller 60 controls the biasing force changing mechanisms 45, 46 to balance suitable transfer loads in relation to the speed difference and the frictional force between the transfer roller 10 and the photoconductive drum 7 (or sheet S) and the driving force from the drive gear 57. Such a control suppresses a vibrating state (escaping motion from the drum) of the transfer roller 10.

As shown in FIG. 1, the sheet S having the toner image transferred thereto is conveyed to the fixing device 24 and has the toner image thermally fixed while passing the fixing device 24. The sheet S having the toner image fixed thereto is discharged to the discharge tray 4 in a face-down state through the discharge path 29 by the conveyor roller pairs 31, 32 and the discharge roller pair 33.

In the case of continuous printing, the controller 60 sets the eccentric cams 51, 52 at their initial positions again to start the next printing in a similar procedure.

Next, a case is described where printing is performed using a small B5-size sheet. A user uses the manual feed tray 6 and sets the sheet on the manual feed tray 6. A print signal for the B5 size is transmitted to the controller 60 of the printer 1 from a personal computer by the user to input sheet information to the controller 60 of the printer main body 2. Since the sheet S is the B5-size sheet having a small width and normally frequently used, the controller 60 controls the mechanism unit 59 to set the eccentric cams 51, 52 suitable for the B5-size sheet.

In this case, if the biasing force changing mechanisms 45, 46 are so set as to give biasing forces to A4-size sheets accommodated in the cassette 16, the controller 60 rotates the eccentric cams 51, 52 to increase the distances between the roller bearings 43, 44 and the operation plates 49, 50 and sets them at the positions suitable for B5-size sheets. At this time, the controller 60 switches transfer pressing forces of the transfer roller 10 to the photoconductive drum 7 separately for the driven side (side where the transfer gear 55 is located) at the right end of the roller shaft 42 and the non-driven side at the left end in consideration of the sheet size, the sheet thickness, the temperature/humidity environment, the image density, the surface state of the photoconductive drum, the processing speed and the like. Thus, the controller 60 sets the biasing force changing mechanisms 45, 46 in a direction as to extend the coil springs 47, 48, thereby reducing the transfer pressing forces of the transfer roller 10 to the photoconductive drum 7.

When this B5-size sheet passes through the transfer nip between the photoconductive drum 7 and the transfer roller 10, this sheet S is conveyed in the intermediate area W1 of the transfer roller 10. The transfer roller 10 has the same outer diameter in the intermediate area W1, and the outer diameter gradually increases toward the outer sides in the outer areas W2 outside the intermediate area W1 so that the outer areas W2 have a reverse crown shape. Thus, air gaps, which would have been formed at the opposite widthwise ends of the B5-size sheet S, can be eliminated to suppress the formation of black dots.

In the outer areas W2, the surface of the photoconductive drum 7 and that of the transfer roller 10 are in direct contact and there is a speed difference of 4% to 6% between them. At this time, a friction coefficient in the contact part of the transfer roller 10 and the photoconductive drum 7 may become higher when the small B5-size sheet passes than when the large A4-size sheet passes due to the influence of the adhesion of ozone products caused by the discharge of the transfer roller and the absence of surface polishing by the sheet. In such a state, the driven side more easily escapes since a frictional force in the contact part of the photoconductive drum 7 and the transfer roller 10 becomes larger. Thus, the controller 60 appropriately controls the biasing force changing mechanism 46 to appropriately (relatively stronger) adjust the transfer pressing force of the transfer roller 10 to the photoconductive drum 7, thereby eliminating the air gap and preventing the destruction of the photoconductive layer of the photoconductive drum 7 caused by the discharge.

In this way, transfer loads are suitably balanced with respect to the speed difference and the frictional force between the transfer roller 10 and the photoconductive drum 7 (or sheet S) and the driving force from the drive gear 57, whereby a vibrating state (escaping motion from the drum) of the transfer roller 10 can be maximally suppressed and the destruction of the photoconductive layer can be prevented to suppress the formation of black dots.

Next, a second embodiment of the present invention is described with reference to FIG. 5. In the second embodiment, the same parts as those of the first embodiment are described while being identified by the same reference numerals. Some of the same parts as those of the first embodiment are repeatedly described, whereas those not described have the same constructions as in the first embodiment.

Figure 5:
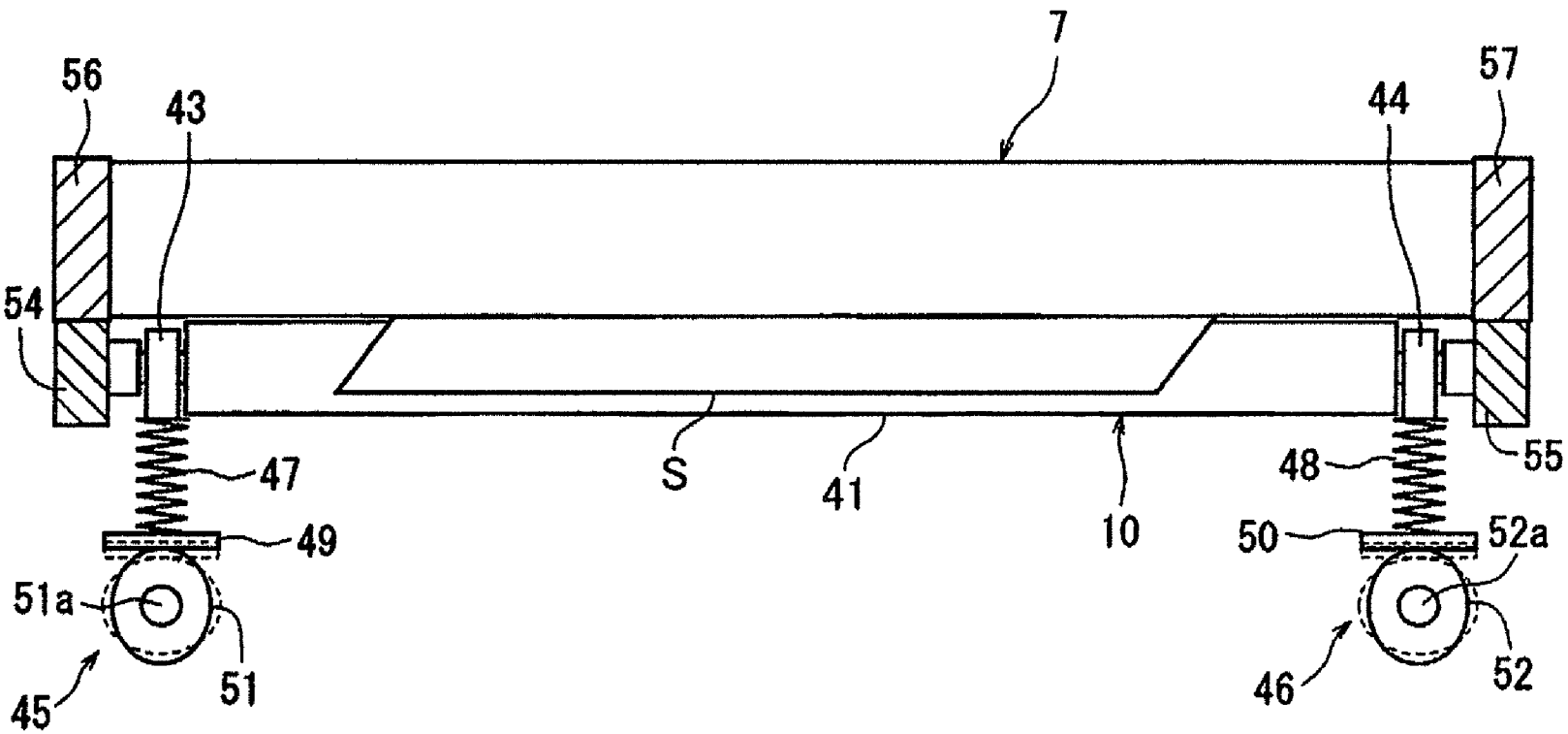
FIG. 5 is a front view showing a photoconductive drum and a transfer roller used in a second embodiment and a part of their periphery.

A photoconductor of a photoconductive drum 7 shown in FIG. 5 is made of amorphous silicon (or material containing amorphous silicon). A drive gear 56 (first drive gear) in the form of a helical gear is mounted on one end (third end portion) of the photoconductive drum 7. Similar to the first embodiment, a drive gear 57 (second drive gear) in the form of a helical gear is mounted on the other end (fourth end portion) of the photoconductive drum 7.

A transfer roller 10 is arranged below the photoconductive drum 7, and a foam sponge roller of the electron conductive type provided with a conductive property by dispersing and mixing carbon in an EPDM base polymer is used as a roller main body 41 in this embodiment. The roller main body 41 having a volume resistance value of about 7 to 7.5 log 106 and a rubber hardness of about 35 degrees or higher is preferably used.

The roller main body 41 of the transfer roller 10 has a constant diameter from one end to the other end in a longitudinal direction. A left end portion (first end portion) and a right end portion (second end portion) of a roller shaft 42 are respectively rotatably supported by roller bearings 43, 44. The respective roller bearings 43, 44 are supported by biasing force changing mechanisms 45, 46. The biasing force changing mechanisms 45, 46 have the same structures as those of the first embodiment.

The left end portion of the roller shaft 42 of the transfer roller 10 penetrates through the roller bearing 43 and a transfer gear 54 (first transfer gear) in the form of a helical gear is mounted on the leading end thereof. The transfer gear 54 is meshed with and driven by the drive gear 56 of the photoconductive drum 7 in this embodiment. A speed ratio of the transfer gear 54 and the drive gear 56 is so set that the rotational speed of the outer circumferential surface of the transfer roller 10 is 4% to 6% faster than that of the outer circumferential surface of the photoconductive drum 7. Similar to the first embodiment, a transfer gear 55 (second transfer gear) is mounted on the right end portion of the roller shaft 42. This transfer gear 55 and the drive gear 57 of the photoconductive drum 7 are meshed and a speed ratio thereof is same as at the left end portion.

The first and second transfer gears 54, 55 have the same gear pitch and the same shape, and the first and the second drive gears 56, 57 have the same gear pitch and the same shape. The first and second transfer gears 54, 55 and the first and second drive gears 56, 57 are mounted such that the mesh of the second transfer gear 55 and the second drive gear 57 is shifted from that of the first transfer gear 54 and the first drive gear 56 by half the gear pitch. In other words, the first and second drive gears 56, 57 are respectively mounted on the left and right ends of the photoconductive drum 7 while being shifted by half the gear pitch. Conforming to this, the first and second transfer gears 54, 55 are respectively mounted on the left and right ends of the transfer roller 10 while being shifted by half the gear pitch.

Since the transfer roller 10 gives the transfer pressing forces to the photoconductive drum 7 by the spring loads of the coil springs 47, 48, the roller shaft 42 is not fixed. Accordingly, the roller shaft 42 is so affected as to vibrate toward the side away from the photoconductive drum 7 against the biasing forces of the coil springs 47, 48 due to vibration and impact caused by the rotation of the drive gears 56, 57 of the photoconductive drum 7.

Next, functions of the image forming apparatus 1 in the second embodiment are described. For example, a case is assumed where printing is performed using an A4-size sheet accommodated in the cassette 16 in the printer 1 shown in FIG. 1. A print signal for A4 size is transmitted from a personal computer to the controller 60 of the printer 1 by a user to input sheet information in the controller 60 of the printer main body 2. Here, if the biasing force changing mechanisms 45, 46 are set for the small size and are not so set as to give biasing forces suitable for the A4 size as the large size to the transfer roller 10, the controller 60 controls the mechanism unit 59 to set the eccentric cams 51, 52 at positions suitable for the A4 size.

Specifically, if the biasing force changing mechanisms 45, 46 are set for the B5 size, the controller 60 rotates the eccentric cams 51, 52 to narrow the distances between the roller bearings 43, 44 and operation plates 49, 50 to set the eccentric cams 51, 52 at the positions suitable for the A4 size. At this time, the controller 60 switches the transfer pressing forces of the transfer roller 10 to the photoconductive drum 7 jointly or separately for the right and left end portions of the roller shaft 42 in consideration of the sheet size, the sheet thickness, the temperature/humidity environment, the image density, the surface state of the photoconductive drum, the processing speed and the like.

As a result, the controller 60 sets the biasing force changing mechanisms 45, 46 in such a direction as to contract the coil springs 47, 48, thereby increasing the transfer pressing forces of the transfer roller 10 to the photoconductive drum 7. Since loads at the opposite ends of the transfer roller 10 and the photoconductive drum 7 are well-balanced when the A4-size sheet passes through the transfer nip between the photoconductive drum 7 and the transfer roller 10, an image is transferred to the sheet in a relatively stable state.

Next, a case is described where printing is performed using a small B5-size sheet. A user uses the manual feed tray 6 and sets the sheet on the manual feed tray 6. A print signal for the B5 size is transmitted from a personal computer to the controller 60 of the printer 1 by the user to input sheet information to the controller 60 of the printer main body 2. Since the sheet S is the B5-size sheet having a small width and normally frequently used, the controller 60 controls the mechanism unit 59 to set the eccentric cams 51, 52 for the B5-size sheet.

In this case, if the biasing force changing mechanisms 45, 46 are so set as to give biasing forces to A4-size sheets accommodated in the cassette 16, the controller 60 rotates the eccentric cams 51, 52 to increase the distances between the roller bearings 43, 44 and the operation plates 49, 50 and sets them at the positions suitable for B5-size sheets. At this time, the controller 60 switches the transfer pressing forces of the transfer roller 10 to the photoconductive drum 7 jointly or separately for the right and left end portions of the roller shaft 42 in consideration of the sheet size, the sheet thickness, the temperature/humidity environment, the image density, the surface state of the photoconductive drum, the processing speed and the like. Thus, the controller 60 sets the biasing force changing mechanisms 45, 46 in a direction as to extend the coil springs 47, 48, thereby reducing the transfer pressing forces of the transfer roller 10 to the photoconductive drum 7.

When this B5-size sheet passes through the transfer nip between the photoconductive drum 7 and the transfer roller 10, the surfaces of the photoconductive drum 7 and the transfer roller 10 are directly in contact with the sheet S and there is a speed difference of 4% to 6% between the photoconductive drum 7 and the transfer roller 10. At this time, a friction coefficient in the contact part of the transfer roller 10 and the photoconductive drum 7 may become higher when the small B5-size sheet passes than when the large A4-size sheet passes due to the absence of the influence of the adhesion of ozone products caused by the discharge of the transfer roller 10 and the absence of surface polishing by the sheet.

However, in this embodiment, the biasing forces are reduced by inputting the driving forces for the transfer roller 10 to the opposite ends of the roller shaft 42 and making transfer load setting equal at the opposite ends of the roller shaft 42. This prevents pressing forces larger than necessary from being exerted to the transfer roller 10. Accordingly, even if there is a rotational speed difference between the photoconductive drum 7 and the transfer roller 10, the frictional force between the photoconductive drum 7 and the transfer roller 10 can become smaller than before and the vibration of the transfer roller 10 can be reduced. Further, the controller 60 appropriately controls the biasing force changing mechanisms 45, 46, whereby the air gaps can be eliminated and the destruction of the photoconductive layer of the photoconductive drum 7 caused by the discharge can be prevented.

Further, vibration created at each gear pitch can be reduced by shifting the phases of the first and second drive gears 56, 57 at the opposite ends of the roller shaft 42 by half the gear pitch. This contributes to the suppression of jitter, density unevenness and black dots formed at the gear pitch.

Furthermore, the transfer loads can be appropriately balanced with respect to the speed difference and the frictional force between the transfer roller 10 and the photoconductive drum 7 (or sheet) and the driving forces from the drive gears. Thus, a vibrating state (escaping motion from the drum) of the transfer roller 10 can be maximally suppressed and the destruction of the photoconductive layer can be prevented to suppress the formation of black dots.

Next, a third embodiment of the present invention is described with reference to FIGS. 6 and 7. In the third embodiment, the same parts as those of the first and second embodiments are described while being identified by the same reference numerals. Some of the same parts as those of the above embodiments are repeatedly described, whereas those not described have the same constructions as in the first and second embodiments.

Figure 6:
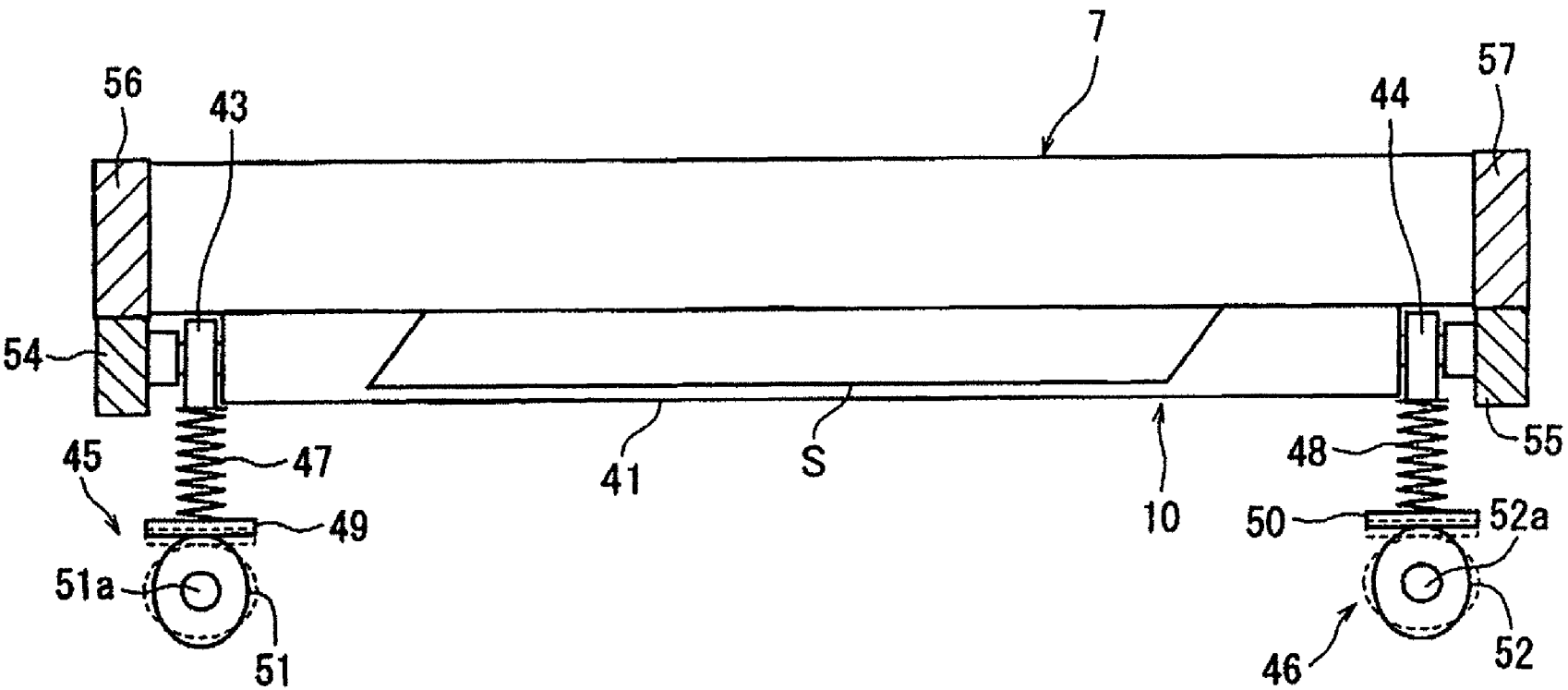
FIG. 6 is a front view mainly showing a photoconductive drum and a transfer roller used in a third embodiment.

A photoconductor of a photoconductive drum 7 shown in FIG. 6 is made of amorphous silicon (or material containing amorphous silicon). A drive gear 56 (first drive gear) in the form of a helical gear is mounted on one end (third end portion) of the photoconductive drum 7. Similar to the first embodiment, a drive gear 57 (second drive gear) in the form of a helical gear is mounted on the other end (fourth end portion) of the photoconductive drum 7.

A transfer roller 10 is arranged below the photoconductive drum 7, and a foam sponge roller of the electron conductive type provided with a conductive property by dispersing and mixing carbon in an EPDM base polymer is used as a roller main body 41 in this embodiment. The roller main body 41 having a volume resistance value of about 7 to 7.5 log Ω and a rubber hardness of about 35 degrees or higher is preferably used.

Figure 7:
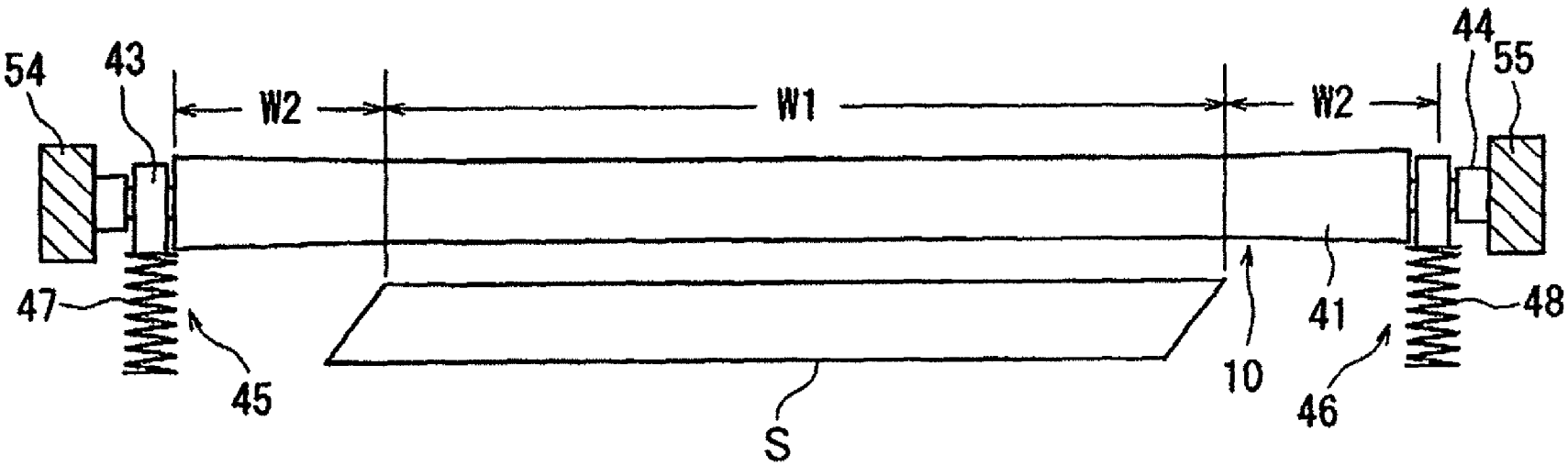
FIG. 7 is a front view showing the photoconductive drum and the transfer roller used in the third embodiment and a part of their periphery.
Figure 8A:
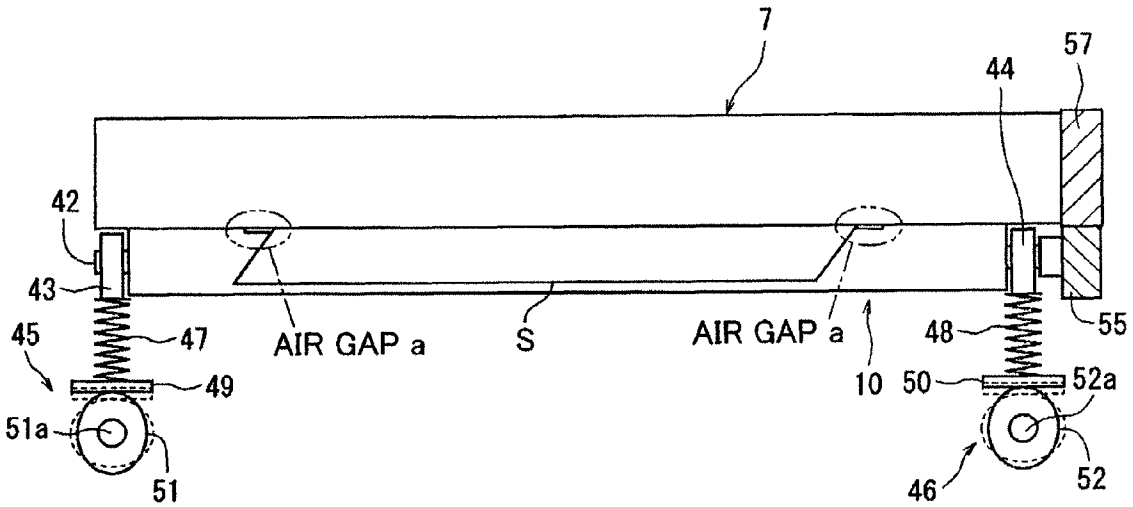
FIG.8A PRIOR ART
Figure 8B:
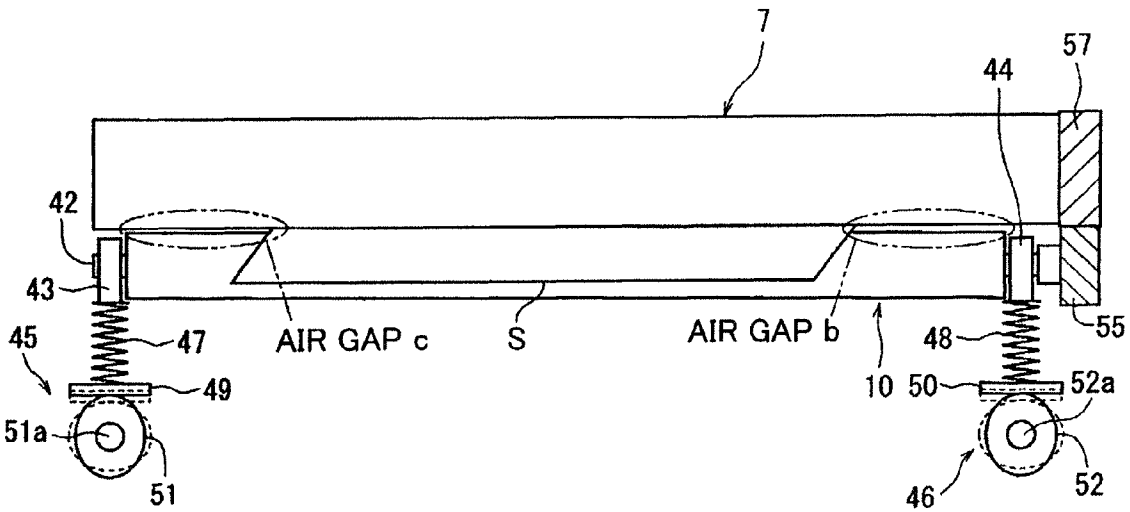
FIG.8B PRIOR ART

As shown in FIG. 7, the roller main body 41 have a constant outer diameter in an intermediate area W1 (first part) in a longitudinal direction of a roller shaft 42, and the outer diameters of outer areas W2 (second parts) at the opposite sides of the intermediate area W1 are gradually and moderately increased toward the outer sides in the longitudinal direction of the roller shaft 42 so that the outer areas W2 have a reverse crown shape. There are two ways of determining the width of the intermediate area W1 (width of a specified sheet size). One is to set the minimum width of sheets S, which can pass the transfer roller 10, as the intermediate area W1, and the other is to set the width of most frequently used sheets S excluding large size sheet widths out of sheets used in the printer main body 2 as the intermediate area W1. Of course, the formed position of the intermediate area W1 is so set as to coincide with a position to be touched by these sheets when they pass the transfer nip.

A left end portion and a right end portion of the roller shaft 42 are respectively rotatably supported by roller bearings 43, 44. The respective roller bearings 43, 44 are supported by biasing force changing mechanisms 45, 46. The biasing force changing mechanisms 45, 46 have the same structures as those of the first embodiment.

The left and right end portions of the roller shaft 42 of the transfer roller 10 penetrate through the roller bearings 43, 44 and first and second transfer gears 54, 55 in the form of helical gears are mounted on the leading ends thereof. The first and second transfer gears 54, 55 are meshed with first and second drive gears 56, 57 mounted on the opposite ends of the photoconductive drum 7. A speed ratio of the first and second transfer gears 54, 55 and the first and second drive gears 57 is so set that the rotational speed of the outer circumferential surface of the transfer roller 10 is 4% to 6% faster than that of the outer circumferential surface of the photoconductive drum 7.

The first and second transfer gears 54, 55 used have the same gear pitch and the same shape, and the first and the second drive gears 56, 57 used have the same gear pitch and the same shape. The first and second transfer gears 54, 55 and the first and second drive gears 56, 57 are mounted such that the mesh of the second transfer gear 55 and the second drive gear 57 is shifted from that of the first transfer gear 54 and the first drive gear 56 by half the gear pitch.

Since the transfer roller 10 gives transfer pressing forces to the photoconductive drum 7 by the spring forces of coil springs 47, 48, the roller shaft 42 is not fixed. Accordingly, the roller shaft 42 is so affected as to vibrate toward the side away from the photoconductive drum 7 against the biasing forces of the coil springs 47, 48 due to vibration and impact caused by the rotation of the drive gears 56, 57 of the photoconductive drum 7.

Next, functions of the image forming apparatus 1 in the third embodiment are described. For example, a case is assumed where printing is performed using an A4-size sheet accommodated in the cassette 16 in the printer 1 shown in FIG. 1. A print signal for A4 size is transmitted from a personal computer to the controller 60 of the printer 1 by a user to input sheet information in the controller 60 of the printer main body 2. Here, if the biasing force changing mechanisms 45, 46 are not so set as to give biasing forces suitable for the A4 size as the large size to the transfer roller 10, the controller 60 controls the mechanism unit 59 to set eccentric cams 51, 52 at positions suitable for the A4 size.

Specifically, if the biasing force changing mechanisms 45, 46 are set for the B5 size, the controller 60 rotates the eccentric cams 51, 52 to narrow the distances between the roller bearings 43, 44 and operation plates 49, 50 to set the eccentric cams 51, 52 at the positions suitable for the A4 size. At this time, the controller 60 switches the transfer pressing forces of the transfer roller 10 to the photoconductive drum 7 jointly or separately for the right and left end portions of the roller shaft 42 in consideration of the sheet size, the sheet thickness, the temperature/humidity environment, the image density, the surface state of the photoconductive drum, the processing speed and the like. As a result, the controller 60 sets the biasing force changing mechanisms 45, 46 in a direction to contract the coil springs 47, 48, thereby increasing the transfer pressing forces of the transfer roller 10 to the photoconductive drum 7.

When the A4-size sheet S passes through the transfer nip between the photoconductive drum 7 and the transfer roller 10, it is conveyed while extending to the outer areas W2 beyond the intermediate area W1 of the transfer roller 10. Accordingly, only small parts of the transfer roller 10 and the photoconductive drum 7 are in direct contact and the image is transferred to the sheet in a relatively stable state.

Next, a case is described where printing is performed using a small B5-size sheet. A user uses the manual feed tray 6 and sets the sheet on the manual feed tray 6. A print signal for the B5 size is transmitted to the controller 60 of the printer 1 from a personal computer by the user to input sheet information to the controller 60 of the printer main body 2. Since the sheet S is the B5-size sheet having a small width and normally frequently used, the controller 60 controls the mechanism unit 59 to set the eccentric cams 51, 52 suitable for the B5-size sheet.

In this case, if the biasing force changing mechanisms 45, 46 are so set as to give biasing forces to A4-size sheets accommodated in the cassette 16, the controller 60 rotates the eccentric cams 51, 52 to increase the distances between the roller bearings 43, 44 and the operation plates 49, 50 and sets them at the positions suitable for B5-size sheets. At this time, the controller 60 switches transfer pressing forces of the transfer roller 10 to the photoconductive drum 7 jointly or separately for the right and left end portions of the roller shaft 42 in consideration of the sheet size, the sheet thickness, the temperature/humidity environment, the image density, the surface state of the photoconductive drum, the processing speed and the like. Thus, the controller 60 sets the biasing force changing mechanisms 45, 46 in a direction as to extend the coil springs 47, 48, thereby reducing the transfer pressing forces of the transfer roller 10 to the photoconductive drum 7.

When this B5-size sheet passes through the transfer nip between the photoconductive drum 7 and the transfer roller 10, the surfaces of the photoconductive drum 7 and the transfer roller 10 are directly in contact with the sheet S and there is a speed difference of 4% to 6% between the photoconductive drum 7 and the transfer roller 10. At this time, a friction coefficient in the contact part of the transfer roller 10 and the photoconductive drum 7 may become higher when the small B5-size sheet passes than when the large A4-size sheet passes due to the influence of the adhesion of ozone products caused by the discharge of the transfer roller 10 and the absence of surface polishing by the sheet.

Even if the friction coefficient in the contact part of the transfer roller 10 and the photoconductive drum 7 becomes high in this way, the biasing forces are reduced by inputting the driving forces for the transfer roller 10 to the opposite ends of the roller shaft 42 and making transfer load setting equal at the opposite ends of the roller shaft 42. This prevents pressing forces larger than necessary from being exerted to the transfer roller 10. Accordingly, even if there is a rotational speed difference between the photoconductive drum 7 and the transfer roller 10, the frictional force between the photoconductive drum 7 and the transfer roller 10 can become smaller than before and the vibration of the transfer roller 10 can be reduced.

When this B5-size sheet passes through the transfer nip between the photoconductive drum 7 and the transfer roller 10, this sheet S is conveyed in the intermediate area W1 of the transfer roller 10. The transfer roller 10 has the constant outer diameter in the intermediate area W1, and the outer diameter gradually increases toward the outer sides in the outer areas W2 outside the intermediate area W1 so that the outer areas W2 have a reverse crown shape. Thus, air gaps, which would have been formed at the opposite widthwise ends of the B5-size sheet S, can be eliminated to suppress the formation of black dots.

Further, the controller 60 appropriately controls the biasing force changing mechanisms 45, 46, thereby preventing the air gaps from getting larger and the notable formation of black dots.

Further, vibration created at each gear pitch can be reduced by shifting the phases of the first and second drive gears 56, 57 at the opposite ends of the roller shaft 42 by half the gear pitch. This contributes to the suppression of jitter, density unevenness and black dots formed at the gear pitch.

Furthermore, the transfer loads can be appropriately balanced with respect to the speed difference and the frictional force between the transfer roller 10 and the photoconductive drum 7 (or sheet) and the driving forces from the drive gears. Thus, a vibrating state (escaping motion from the drum) of the transfer roller 10 can be maximally suppressed and the destruction of the photoconductive layer can be prevented to suppress the formation of black dots.

Although the present invention is described in detail based on the embodiments with reference to the accompanying drawings, it is not limited to the above embodiments and other modifications or changes can be made without departing from the scope of the present invention.

For example, although the biasing force changing mechanisms 45, 46 have a cam structure in the above embodiments, pressing forces may be appropriately changed by vertically movable extensible members.

The above specific embodiments mainly include inventions having the following constructions.

An image forming apparatus according to one aspect of the present invention comprises an image bearing member on which a toner image is to be formed; a transfer roller held in direct contact with a surface of the image bearing member for transferring a toner image on the image bearing member to one side of a transfer medium by applying a voltage having a polarity opposite to that of the toner image formed on the image bearing member from the other side of the transfer medium; a driving mechanism for respectively rotating the transfer roller and the image bearing member with a specified speed difference; and a biasing member for biasing the transfer roller toward the surface of the image bearing member, wherein the transfer roller is shaped such that the outer diameter of a first part corresponding to the width of a specified sheet size is constant and the outer diameters of second parts located closer to the opposite ends of the transfer roller than the first part are gradually increased toward the outer sides in an axial direction of the transfer roller.

According to this construction, the first part (e.g. width of the minimum sheet size or width of a frequently used small sheet size) of the transfer roller has the constant outer diameter and the second parts at the opposite outer sides of the first part are so shaped that the outer diameters thereof are gradually increased toward the outer sides of the roller (reverse crown shape). Thus, air gaps at the outer sides of ends of a small size sheet can be better followed and the formation of black dots caused by the destruction of a drum photoconductive layer can be suppressed.

In the above construction, it is preferable that a biasing force changing mechanism for switching a biasing force of the transfer roller to the image bearing member is further provided; and that the biasing force changing mechanism sets a biasing force given to the transfer roller by the biasing member when a transfer medium of a first size passes between the transfer roller and the image bearing member to be smaller than a biasing force given when a transfer medium of a second size larger than the first size passes.

In this case, it is sufficient for the biasing force changing mechanism to be able to switch the biasing force at least in two stages. For example, its pressing force is switched depending on the sheet size, wherein the pressing force is reduced in the case of a small size while being increased in the case of a large size. By doing so, even if a friction coefficient in a contact part of the transfer roller and the image bearing member becomes higher when a small-size sheet passes than when a large-size sheet passes, the vibration of the transfer roller can be maximally suppressed and the formation of black dots can be suppressed.

In the above construction, it is preferable that the transfer roller includes a first end portion and a second end portion opposite to the first end portion; and that the biasing force changing mechanism switches the biasing force individually at the first and second end portions.

According to this construction, the biasing force can be switched at the first and second end portions based on the sheet size, the sheet thickness, the temperature/humidity environment, the image density, the surface state of a photoconductive drum, the processing speed and the like. By doing so, transfer loads can be appropriately balanced with respect to the speed difference and the frictional force between the transfer roller and the drum (or transfer medium) and a driving force from a drive gear, whereby a vibrating state (escaping motion from the drum) of the transfer roller can be maximally suppressed and the formation of black dots can be suppressed.

In this case, the biasing force changing mechanism preferably adjusts the biasing force in relation to loads respectively exerted to the first and second end portions. According to this construction, transfer load setting can be made equal at the opposite end portions and set values can be reduced. Thus, pressing forces larger than necessary are not exerted and, even if there is a speed difference between the photoconductor and the transfer roller, a frictional force between the photoconductor and the transfer roller is smaller than before, wherefore the vibration of the transfer roller can be reduced.

In the above construction, the image bearing member is preferably an a-Si photoconductor.

An image forming apparatus according to another aspect of the present invention comprises a cylindrical image bearing member on which a toner image is to be formed; a transfer roller held in direct contact with a surface of the image bearing member for transferring a toner image on the image bearing member to one side of a transfer medium by applying a voltage having a polarity opposite to that of the toner image formed on the image bearing member from the other side of the transfer medium; a drive gear mounted coaxially with the image bearing member for rotating the image bearing member about an axis; a transfer gear mounted coaxially with the transfer roller and meshed with the drive gear to rotate the transfer roller about an axis; a driving mechanism for respectively rotating the transfer roller and the image bearing member with a specified speed difference; and a biasing member for biasing the transfer roller toward the surface of the image bearing member, wherein the drive gear includes a first drive gear mounted on a third end portion of the image bearing member and a second drive gear mounted on a fourth end portion opposite to the third end portion, and the transfer gear includes a first transfer gear mounted on a fifth end portion of the transfer roller and meshed with the first drive gear and a second transfer gear mounted on a sixth end portion opposite to the fifth end portion and meshed with the second drive gear.

Previously, either one of a driven side or a non-driven side of the transfer roller was likely to escape from a drum depending on the magnitude of a frictional force between a photoconductor or transfer medium and a transfer roller and, in such a case, black dots became particularly notable in some cases. However, according to the above construction, it is possible to prevent only an air gap at one side from becoming larger and to prevent the notable formation of black dots since driving forces are input to both the fifth and sixth end portions of the transfer roller.

In this case, the biasing member preferably gives substantially the same biasing forces to the fifth and sixth end portions of the transfer roller.

The biasing member preferably includes a first biasing member arranged in correspondence with the fifth end portion for giving the biasing force to the fifth end portion and a second biasing member arranged in correspondence with the sixth end portion for giving the biasing force to the sixth end portion.

In the above construction, it is preferable that the first and second drive gears are respectively mounted on the third and fourth end portions such that a gear pitch of the first drive gear and that of the second drive gear are shifted by substantially a half phase; and that the first and second transfer gears are respectively so mounted on the fifth and sixth end portions as to correspond to the substantially half-phase shift.

According to this construction, it is possible to reduce vibration created at each gear pitch and to suppress jitter, density unevenness and black dots formed at the gear pitch by mounting the first and second drive gears on the third and fourth end portions while shifting the phases of the first and second drive gears by half the gear pitch.

It is preferable that the transfer roller is shaped such that the outer diameter of a first part corresponding to the width of a specified sheet size is constant and the outer diameters of second parts closer to opposite ends than the first part are gradually increased toward the outer sides in an axial direction of the transfer roller.

According to this construction, by forming the transfer roller to have a reverse crown shape as described above, air gaps outside ends of a small size sheet can be better followed and the formation of black dots caused by the destruction of the drum photoconductive layer can be suppressed.

In the above construction, it is preferable to further comprise a biasing force changing mechanism for switching the biasing force of the transfer roller to the image bearing member.

In this case, the biasing force changing mechanism preferably sets a biasing force given to the transfer roller by the biasing member when a transfer medium of a first size sheet passes between the transfer roller and the image bearing member to be smaller than a biasing force given when a transfer medium of a second size larger than the first size passes.

For example, the biasing force of the transfer roller is made switchable at least in two stages, and its pressing force is switched depending on the sheet size, wherein the pressing force is reduced in the case of a small size while being increased in the case of a large size. By doing so, even if a friction coefficient between the transfer roller and a contact part of the photoconductor becomes higher when a small-size sheet passes than when a large-size sheet passes, the vibration of the transfer roller can be maximally suppressed and the formation of black dots can be suppressed.

This application is based on Japanese Patent Application Serial No. 2009-127881, filed in Japan Patent Office on May 27, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a cylindrical image bearing member on which a toner image is to be formed;

a transfer roller held in direct contact with a surface of the image bearing member for transferring a toner image on the image bearing member to one side of a transfer medium by applying a voltage having a polarity opposite to that of the toner image formed on the image bearing member from the other side of the transfer medium;

a drive gear mounted coaxially with the image bearing member for rotating the image bearing member about an axis;

a transfer gear mounted coaxially with the transfer roller and meshed with the drive gear to rotate the transfer roller about an axis;

a driving mechanism for respectively rotating the transfer roller and the image bearing member with a specified speed difference; and a biasing member for biasing the transfer roller toward the surface of the image bearing member, wherein:

the drive gear includes a first drive gear mounted on a first end portion of the image bearing member and a second drive gear mounted on a second end portion of the image bearing member opposite to the first end portion of the image bearing member, the transfer gear includes a first transfer gear mounted on a first end portion of the transfer roller and meshed with the first drive gear and a second transfer gear mounted on a second end portion of the transfer roller opposite to the first end portion of the transfer roller and meshed with the second drive gear, the first and second drive gears are mounted respectively on the first and second end portions of the image bearing member such that a gear pitch of the first drive gear and that of the second drive gear are shifted by a half phase, and the first and second transfer gears respectively are mounted on the first and second end portions to correspond to the half-phase shift.

2. The image forming apparatus according to claim 1, wherein the biasing member gives substantially the same biasing forces to the first and second end portions of the transfer roller.

3. The image forming apparatus according to claim 2, wherein the biasing member includes a first biasing member arranged in correspondence with the first end portion of the transfer roller for giving the biasing force to the first end portion and a second biasing member arranged in correspondence with the second end portion of the transfer roller for giving the biasing force to the second end portion of the transfer roller.

4. The image forming apparatus according to claim 1, wherein the transfer roller has a reverse crown shape so that the outer diameter of a first part corresponding to the width of a specified sheet size is constant and the outer diameters of second parts closer to opposite ends than the first part are increased toward the outer sides in an axial direction of the transfer roller.

5. The image forming apparatus according to claim 1, further comprising a biasing force changing mechanism for switching the biasing force of the transfer roller to the image bearing member.

6. The image forming apparatus according to claim 5, wherein the biasing force changing mechanism sets a biasing force given to the transfer roller by the biasing member when a transfer medium of a first size sheet passes between the transfer roller and the image bearing member to be smaller than a biasing force given when a transfer medium of a second size larger than the first size passes.

7. The image forming apparatus according to claim 1, wherein the image bearing member is an a-Si photoconductor.

8. An image forming apparatus, comprising:

a cylindrical image bearing member on which a toner image is to be formed;

a transfer roller held in direct contact with a surface of the image bearing member for transferring a toner image on the image bearing member to one side of a transfer medium by applying a voltage having a polarity opposite to that of the toner image formed on the image bearing member from the other side of the transfer medium;

a drive gear mounted coaxially with the image bearing member for rotating the image bearing member about an axis;

a transfer gear mounted coaxially with the transfer roller and meshed with the drive gear to rotate the transfer roller about an axis;

a driving mechanism for respectively rotating the transfer roller and the image bearing member with a specified speed difference; and a biasing member for biasing the transfer roller toward the surface of the image bearing member, wherein: the drive gear includes a first drive gear mounted on a first end portion of the image bearing member and a second drive gear mounted on a second end portion of the image bearing member opposite to the first end portion of the image bearing member, the transfer gear includes a first transfer gear mounted on a first end portion of the transfer roller and meshed with the first drive gear and a second transfer gear mounted on a second end portion of the transfer roller opposite to the first end portion of the transfer roller and meshed with the second drive gear, the transfer roller has a reverse crown shape so that the outer diameter of a first part corresponding to the width of a specified sheet size is constant and the outer diameters of second parts of the transfer roller closer to opposite ends than the first part are increased toward the outer sides in an axial direction of the transfer roller, the first and second drive gears are respectively mounted on the first and second end portions of the image bearing member such that a gear pitch of the first drive gear and that of the second drive gear are shifted by a half phase, and the first and second transfer gears are respectively so mounted on the first and second end portions of the transfer roller to correspond to the half-phase shift.

9. The image forming apparatus according to claim 8, wherein the first and second parts of the transfer roller are disposed to be held in direct contact with the surface of the image bearing member.

10. The image forming apparatus according to claim 8, wherein the transfer roller includes a roller shaft and a roller main body covering the roller shaft, roller bearings spaced outwardly from the roller main body and rotatably supporting opposite ends of the roller shaft, the first and second parts of the transfer roller being on the roller main body.

11. The image forming apparatus according to claim 10, wherein the roller main body comprises a foam sponge roller with conductive properties.

* * * * *